United States Patent [19]

Lyman

[11] 4,429,430

[45] Feb. 7, 1984

[54] VACUUM CLEANER BEATER BRUSH STRUCTURE

[75] Inventor: John B. Lyman, Bloomington, Minn.

[73] Assignee: Whirlpool Corporation, Benton Harbor, Mich.

[21] Appl. No.: 338,665

[22] Filed: Jan. 11, 1982

[51] Int. Cl.[3] ..... A46B 7/10

[52] U.S. Cl. ..... 15/182; 15/366

[58] Field of Search ..... 15/5, 182, 183, 366, 15/370, 372

[56] References Cited

U.S. PATENT DOCUMENTS

| | | | |
|---|---|---|---|
| 1,742,375 | 1/1930 | Bass | 15/366 X |
| 1,743,954 | 1/1930 | Blake . | |
| 1,900,885 | 3/1933 | Smellie | 15/366 X |
| 1,914,834 | 6/1933 | Otto . | |
| 2,140,651 | 12/1938 | Riebel et al. | 15/183 |
| 2,753,583 | 7/1956 | Jepson | 15/183 X |
| 3,608,333 | 9/1971 | Selley et al. | 15/389 X |
| 3,737,937 | 6/1973 | Nordeen | 15/5 X |
| 4,355,436 | 10/1982 | Hertzberg | 15/366 X |

FOREIGN PATENT DOCUMENTS

| | | | |
|---|---|---|---|
| 516291 | 12/1939 | United Kingdom | 15/5 |

*Primary Examiner*—Chris K. Moore

*Attorney, Agent, or Firm*—Wood, Dalton, Phillips, Mason & Rowe

[57] ABSTRACT

A vacuum cleaner beater brush structure having a dowel roller provided with a sprocket for cooperation with a cog belt. The brush structure is elongated for providing a wide cleaning action. A portion of the brush is disposed outboard of the cog belt sprocket. The beater brush includes a novel arrangement of brush and beater bar strips carried in mounting channels in the dowel portion therof. The end brush assembly is mounted to the dowel by mounting structure which further clamps the cog belt sprocket to one end of the dowel.

28 Claims, 5 Drawing Figures

FIG. 1
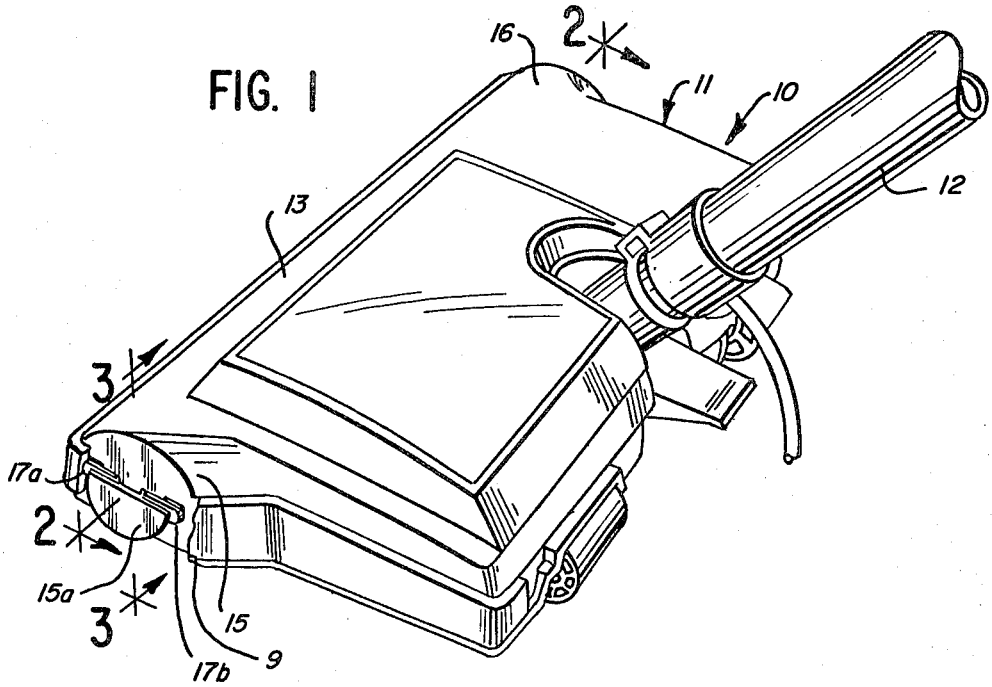
FIG. 2
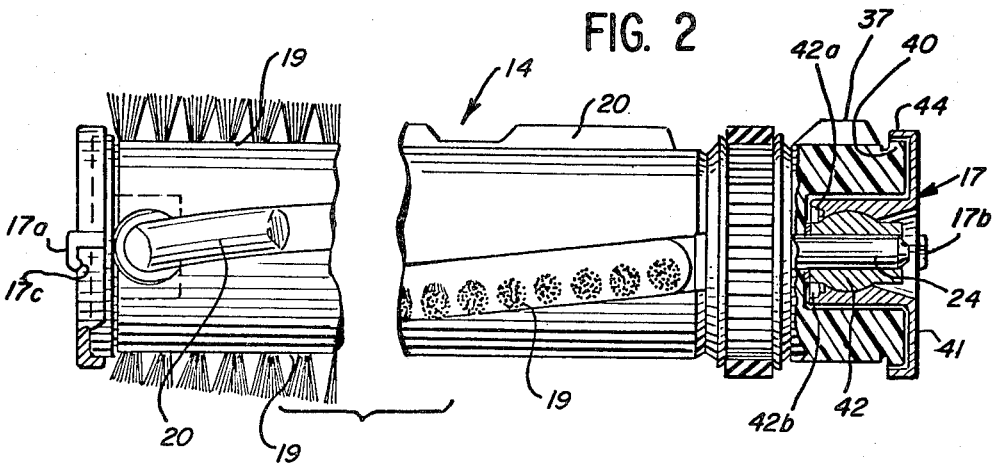
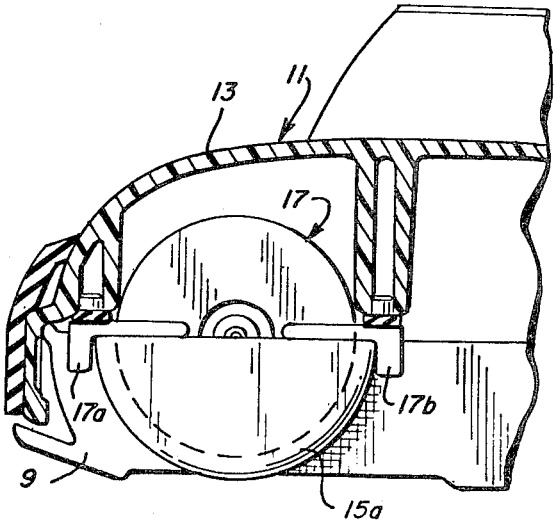
FIG. 3

VACUUM CLEANER BEATER BRUSH STRUCTURE

BACKGROUND OF THE INVENTION

1. Field of the Invention

This invention relates to vacuum cleaner structures and in particular to beater brush structures for use in vacuum cleaners.

2. Description of the Background Art

It is conventional to provide in vacuum cleaners a suction nozzle having mounted internally thereof driven means for agitating the surface being cleaned, such as a carpet or the like, for improved removal of dirt therefrom. In one form, the dirt-agitating means comprises an agitator in the form of a rotatable brush which is driven by means of a belt or the like, either from the suction fan motor or a separate brush motor.

It is also conventional to provide in such dirt-agitating devices beater bars or the like comprising relatively rigid projections which are engaged with the surface to be cleaned on rotation of the brush.

One example of such a combined beater and vacuum cleaner is illustrated in U.S. Pat. No. 1,743,954 of B. F. Blake.

Another example of a vacuum cleaner having a brush-type dirt-agitating means is that disclosed in U.S. Pat. No. 3,608,333 of Wilbur-Webb Shelley et al. As shown therein, the roller carrying the brush bristles is driven by a cog belt.

An example of a dirt-agitator assembly having both brushes and beater elements is that disclosed in U.S. Pat. No. 4,209,873 of Harold W. Schaefer. As shown therein, the roller carrying the brush and beater element is provided with an annular groove for receiving a drive belt to effect rotation thereof, the groove being disposed at an axially midportion of the roller.

It has further been conventional in prior art vacuum cleaner brush rollers to provide the brush tufts in insert strips mounted to the roller for facilitated manufacture. One example of such a strip-mounted brush structure is that disclosed in U.S. Pat. No. 3,874,017 of Russell H. R. Parker.

SUMMARY OF THE INVENTION

The present invention comprehends an improved vacuum cleaner beater brush structure, including a dowel carrying a beater brush, a sprocket having teeth adapted to be driven by a cog belt, a carrier provided with brush tufts, and means for securing the carrier to one end of the dowel, with the sprocket retained therebetween. The invention also comprehends mounting structure for the beater brush structure.

Different elements of the beater brush assembly may define cooperating belt retainer flanges for guiding the belt into engagement with the sprocket teeth.

The carrier may be secured to the end of the dowel by threaded means extended through the carrier and sprocket and threaded to one end of the dowel.

In the illustrated embodiment, the carrier is further provided with a beater element.

In the illustrated embodiment, the sprocket and carrier are provided with interfitted annular shoulders for maintained coaxial disposition thereof.

An axle shaft is mounted to the dowel to project through the sprocket and carrier into a suitable bearing which, in the illustrated embodiment, extends into the carrier.

In the illustrated embodiment, the end brush structure includes a cylindrical carrier, means for mounting the carrier for rotation about the cylindrical axis thereof, a first brush tuft projecting radially from a first circumferential portion of the carrier, a second brush tuft projecting radially from a second circumferentially spaced portion of the carrier, and a beater element projecting radially from a third circumferential portion of the carrier intermediate the brush tufts.

In the illustrated embodiment, the beater element is formed integrally with the carrier.

In broad aspect the invention comprehends the provision of a vacuum cleaner beater brush structure including a pair of cylindrical elements each having brush tufts projecting radially therefrom, a sprocket adapted to be driven by a cog belt, and means for clamping the sprocket coaxially between the cylindrical elements.

In the illustrated embodiment, one of the cylindrical elements has a length a small fraction of that of the other.

In the illustrated embodiment, the sprocket is defined by a pair of axially abutted elements.

The guide flanges, in the illustrated embodiment, are provided one each on the elements of the pair.

In the illustrated embodiment, the brush strips are received in a plurality of helical, circumferentially spaced channels in the brush dowel. A rigid beater bar is disposed intermediate the brush strips.

In the illustrated embodiment, the dowel is provided with axle elements projecting coaxially from opposite ends thereof. The axle elements are carried in bearings mounted on the vacuum cleaner base.

A magnet may be provided within one of the channels of the beater brush dowel for actuating a magnetic speed sensor.

The vacuum cleaner beater brush structure and mounting means therefor of the present invention are extremely simple and economical of construction while yet providing an improved beater brush functioning in a vacuum cleaner or the like.

BRIEF DESCRIPTION OF THE DRAWING

Other features and advantages of the invention will be apparent from the following description taken in connection with the accompanying drawing wherein:

FIG. 1 is a fragmentary perspective view of a vacuum cleaner having a beater brush and brush mount structure embodying the invention;

FIG. 2 is a fragmentary enlarged section taken substantially along the line 2—2 of FIG. 1;

FIG. 3 is a fragmentary section taken substantially along the line 3—3 of FIG. 1 illustrating mounting of the brush bearings to the base of the vacuum cleaner nozzle;

DESCRIPTION OF THE PREFERRED EMBODIMENT

Figure 4:
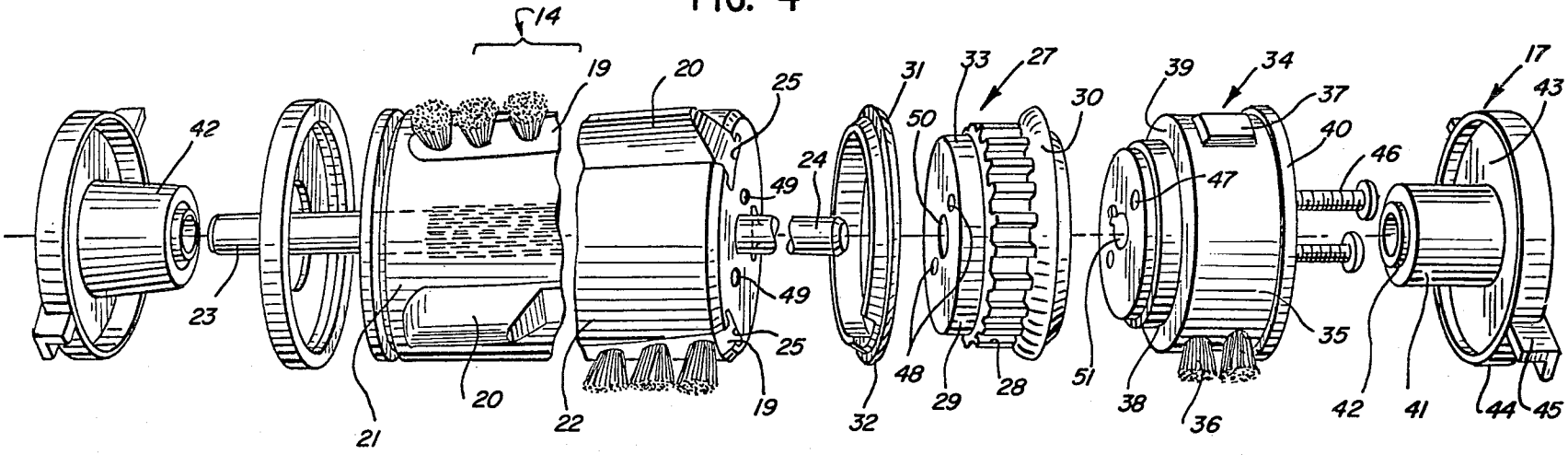
FIG. 4 is an exploded perspective view of the beater brush structure.

In the illustrative embodiment of the invention as disclosed in the drawing, a vacuum cleaner 10 is provided with a nozzle 11 and a handle 12 swingably mounted to the nozzle. The nozzle includes a cover portion 13 housing an agitator or beater brush structure generally designated 14 embodying the invention, and a base portion 9 to which the beater brush bearings are fastened.

As shown in FIG. 1, the forward portion of nozzle 11 is laterally enlarged so as to permit the beater brush structure 14 to clean an area wider than the rear portion of the nozzle.

The opposite end portions 15 and 16 of the front portion of nozzle 11 are adapted to carry bearing mounts 17 for rotatably journaling the beater brush structure. The bearing mounts 17 include an oil-filled bronze sleeve bearing 42, and a resilient "O" ring 42*a*, held in place by a ring washer 42*b*. The bearing housing 41 includes a key, not shown, which cooperates with a keyway, not shown, in bearing 42 to prevent turning of the bearing relative to the housing.

The mounting structure for the beater brush structure 14 includes a pair of zinc die cast bearing mounts 17, one being provided on each end of the brush structure 14. Semi-circular portions of the base of nozzle 9 are formed to project approximately ⅛" outwardly of the nozzle base at the opposite ends of the bearing mounts 17 to provide recesses to receive the lower halves of the bearing mounts. The bearing mounts 17 include diametrically opposed bearing mount tabs 17*a* and 17*b* that overlap shoulder portions of the nozzle base on each side of the projecting portions 15*a*. The tabs 17*a* and 17*b* include projecting tab ends 17*c* that bite into the plastic base and lock the mounts 17 to the base when the mounts 17 are forced downward on the base causing portions of the base to yield and providing an interference fit.

The beater brush structure includes a roller, or dowel, 18 carrying a plurality of helical brush elements or strips 19 and a helical beater bar element or strip 20. In the illustrated embodiment there are two brush elements and one beater bar element, the respective elements being spaced approximately 120° apart. However, the agitator may also be constructed to include one brush element and one beater bar element, spaced approximately 180° apart.

Projecting from opposite ends 21 and 22 of the dowel 18 is a pair of axles 23 and 24.

The strips 19 and 20 are received in undercut channels 25 in dowel 18 and, as seen in FIG. 4, are provided with complementary cross sections for retention in the channels against centrifugal forces developed in rotation of the dowel about the cylindrical axis thereof, as defined by the axles 23 and 24.

Figure 5:
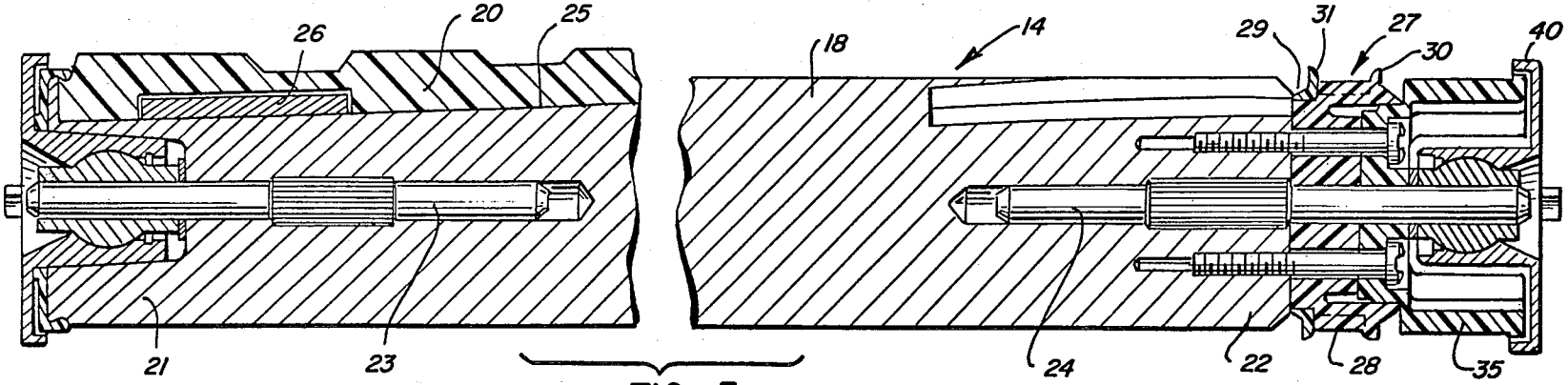
FIG. 5 is a broken diametric section of the assembled beater brush structure.

As further shown in FIG. 5, a magnet 26 may be provided in one of the channels 25 subjacent the beater bar strip 20 therein for actuating a magnetic speed sensor or the like. Thus the magnet may be disposed inwardly of and beneath the beater bar element.

Beater brush structure 14 further includes a sprocket generally designated 27 having teeth 28 adapted to be driven by a cog belt or the like. As shown in FIG. 4, the sprocket includes a first portion 29 teeth 28 formed integrally therewith and defining a belt retainer flange 30 at one axial end of the teeth 28. The sprocket further includes a second portion 31 defining a second belt retainer flange 31. Portion 32 is adapted to be received on a cylindrical end 33 of sprocket portion 29 to dispose the flange 32 at the axially opposite side of the toothed array 28 so as to cooperate with flange 30 in retaining the cog belt in alignment with the toothed array.

An edge brush assembly 34 is provided outboard of the sprocket 27 and, as shown in FIG. 4, includes a carrier 35 provided with a plurality of brush tufts 36 and an integral beater bar 37. The carrier is provided with a reduced diameter end portion 38 adapted to be coaxially received within sprocket 27 to permit flange 30 to abut an annular shoulder 39 at the axially outer end of the reduced portion 38 and to help hold the sprocket concentric with the shaft.

At its axially outer end, the carrier is provided with annular outturned string guard flange shoulder 40.

Bearing 17 includes a bearing housing portion 41 receiving a bearing 42 which, as seen in FIG. 2, journals the axle end 24 for rotation of the beater brush structure within nozzle portion 13. Housing portion 41 includes a transverse outer end wall 43 provided with an inturned flange 44 for cooperating with carrier string guard flange 40 in defining a string guard at the outboard end of the beater brush structure. The radially projecting tabs 45 hold the bearing housing structure in place.

As further seen in FIGS. 4 and 5, edge brush assembly 34 and sprocket 27 are secured to the end of the dowel 18, such as end 22 as seen in FIG. 4, by securing elements generally designated 46 comprising a pair of screws extending through suitable openings 47 in carrier 35, end openings 48 in sprocket portion 29, and into threaded engagement with the end of the dowel 18 in suitable threaded openings 49 therein. Thus, beater brush structure 14 effectively defines a pair of cylindrical elements, such as dowel 18 and carrier 35, each having brush tufts projecting therefrom, a sprocket 27, and means 46 for clamping the sprocket coaxially between the cylindrical elements. The cylindrical element 35, as disclosed, has a length which is only a small fraction of the length of the cylindrical element 18. Thus, the dowel provides the roller for the main beater brush structure of the assembly and the carrier 35 defines the support for the relatively short edge beater brush assembly.

In the illustrated embodiment, the sprocket portion 29 may comprise a molded element for facilitated manufacture. In the illustrated embodiment, the axle 24 extends through a suitable axial opening 50 in the sprocket portion 29 and an axial opening 51 in the carrier 35 for coaxially mounting the sprocket and carrier for rotation in the bearing 42. As shown in FIG. 4, a similar bearing 42 is provided at the opposite end of the dowel for receiving axle 23 and thereby journaling the opposite end of the beater brush assembly.

In the illustrated embodiment, the edge brush assembly tufts are equiangularly spaced about the axis of carrier 35, and more specifically, two pairs of tufts 36 are spaced apart approximately 120° circumferentially thereabout, with the beater bar 37 being spaced 120° between the pair of tufts 36 so that the tufts 36, and the beater bar 37, are respectively aligned with the helical brush strips 19 and the beater bar strip 20 of dowel 18. As seen in FIG. 4, the helical strips 19 and 20, and the tufts 36 and bar 37 are arranged to extend at an angle of approximately 7° to the axial plane of the carrier.

In the illustrated embodiment, the main beater brush assembly on dowel 18 utilizes formed brush and beater bar strips whereas the edge assembly 34 utilizes integral beater bar means and brush tufts mounted directly in the carrier 35.

In the illustrated embodiment, the two portions of the sprocket assembly are maintained in operative association with each other by the clamping of the sprocket to the end of the dowel by the carrier 35, as discussed above.

The foregoing disclosure of specific embodiments is illustrative of the broad inventive concepts comprehended by the invention.

Having described the invention, the embodiments of the invention in which an exclusive property or privilege is claimed are defined as follows:

1. A vacuum cleaner beater brush structure comprising:

a dowel carrying a beater brush;

a sprocket having teeth adapted to be driven by a cog belt;

a carrier provided with brush tufts; and means for securing the carrier to one end of the dowel with said sprocket retained therebetween.

2. The vacuum cleaner beater brush structure of claim 1 wherein said sprocket comprises a molded toothed element and a retainer flange element retained between said toothed element and said one end of the dowel for retaining the cog belt in alignment with said teeth.

3. The vacuum cleaner beater brush structure of claim 1 wherein said means for securing the carrier comprises threaded means extended through the carrier and sprocket and threaded to said one end of the dowel.

4. The vacuum cleaner beater brush structure of claim 1 wherein said carrier is further provided with a beater element.

5. The vacuum cleaner beater brush structure of claim 1 wherein said sprocket and carrier are provided with coaxial annular shoulders for maintaining a coaxial disposition thereof.

6. The vacuum cleaner beater brush structure of claim 1 wherein said sprocket defines an integral retainer flange intermediate said teeth and said carrier for retaining the cog belt in alignment with said teeth.

7. The vacuum cleaner beater brush structure of claim 1 wherein said dowel is provided with an axle shaft projecting through said sprocket and into said carrier.

8. The vacuum cleaner beater brush structure of claim 1 further including a bearing axially outwardly of said carrier, and said dowel is provided with an axle shaft projecting through said sprocket, said carrier, and into said bearing for journaling the brush structure at said one end of the dowel.

9. A vacuum cleaner beater brush structure comprising:

a dowel carrying a beater brush;

a sprocket having teeth adapted to be driven by a cog belt;

a cylindrical carrier;

means for mounting the carrier for rotation about the cylindrical axis thereof;

a first brush tuft projecting radially from a first circumferential portion of the carrier;

a second brush tuft projecting radially from a second circumferentially spaced portion of the carrier;

a beater element projecting radially from a third circumferential portion of the carrier intermediate said brush tufts; and means for securing the carrier to one end of the dowel with said sprocket retained therebetween.

10. The end brush structure of claim 9 wherein said means for mounting the carrier comprises means for mounting the carrier about an axle.

11. The end brush structure of claim 9 wherein said tufts are spaced approximately 120°.

12. The end brush structure of claim 9 wherein said tufts and beater element are equiangularly spaced.

13. The end brush structure of claim 9 wherein said tufts and beater element are equiangularly spaced 120° apart.

14. The end brush structure of claim 9 wherein said beater element is formed integrally with said carrier.

15. The end brush structure of claim 9 wherein each of said tufts comprises a plurality of bristles arranged along a helical line on the circumference of the carrier.

16. The end brush structure of claim 9 wherein each of said tufts comprises a plurality of bristles arranged along a helical line on the circumference of the carrier at an angle of approximately 7° to an axial plane.

17. A vacuum cleaner beater brush structure comprising:

a dowel carrying a beater brush;

a sprocket having teeth adapted to be driven by a cog belt;

a carrier provided with brush tufts; and means for retaining the carrier to one end of the dowel with said sprocket retained therebetween.

18. The vacuum cleaner beater brush structure of claim 17 wherein one of said dowel and carrier has a length a small fraction of that of the other thereof.

19. A vacuum cleaner beater brush structure comprising:

a pair of cylindrical elements each having brush tufts projecting radially therefrom;

a sprocket adapted to be driven by a cog belt; and means for clamping the sprocket coaxially between said cylindrical elements, said sprocket comprising two axially abutted elements.

20. The vacuum cleaner beater brush structure of claim 19 wherein said axially abutted elements cooperatively define axially spaced belt guide flanges and an annular drive tooth array axially intermediate said spaced flanges.

21. The vacuum cleaner beater brush structure of claim 19 wherein said axially abutted elements cooperatively define axially spaced belt guide flanges and an annular drive tooth array axially intermediate said spaced flanges, one of said flanges and said drive tooth array being formed integrally with one of said abutted elements.

22. A vacuum cleaner beater brush structure comprising:

a dowel carrying a beater brush;

a sprocket having teeth adapted to be driven by a cog belt;

a carrier provided with brush tufts;

means for securing the carrier to one end of the dowel with said sprocket retained therebetween;

an axle extending from said dowel through said secured sprocket and into said carrier; and bearing means journaling the axle within said carrier.

23. The vacuum cleaner brush structure of claim 22 wherein there is an axle extending from each end of said dowel and there are bearing means for journaling each of said axles.

24. The vacuum cleaner brush structure of claim 22 wherein said bearing means includes tab means for mounting said brush structure to a vacuum cleaner base.

25. The vacuum cleaner structure of claim 24 wherein said tab means comprises a pair of tabs mounted on diametrically opposed portions of said bearing means.

26. The vacuum cleaner structure of claim 25 wherein said tab means includes projecting portions to lock said bearing means to a vacuum cleaner base.

27. A vacuum cleaner agitator structure comprising:

a dowel carrying a beater brush element and a beater bar element;

a magnet carried by said dowel beneath one of said elements;

a sprocket having teeth adapted to be driven by a cog belt;

a carrier provided with brush tufts; and means for securing the carrier to one end of the dowel with said sprocket retained therebetween.

28. A vacuum cleaner agitator structure as claimed in claim 27 wherein said magnet is disposed inwardly of said beater bar element.

* * * * *